United States Patent [19]

Papadopulos et al.

[11] Patent Number: 4,548,412

[45] Date of Patent: Oct. 22, 1985

[54] HORSESHOE PUZZLE

[76] Inventors: Demetrio I. Papadopulos; George Spector, both of 233 Broadway, RM 3615, New York, N.Y. 10007

[21] Appl. No.: 547,078

[22] Filed: Oct. 31, 1983

[51] Int. Cl.[4] ..... A63F 9/08

[52] U.S. Cl. ..... 273/156; 273/158

[58] Field of Search ..... 273/156, 158

[56] References Cited

U.S. PATENT DOCUMENTS 3,698,719 10/1972 Winslow ..... 273/158

FOREIGN PATENT DOCUMENTS 10499 of 1901 United Kingdom ..... 273/158

OTHER PUBLICATIONS

Johnson, Smith & Co. catalog, copyright 1929, p. 256.

"Creative Puzzles of the World" by Van Delft & Botermans, publ. by Harry N. Abrams, N.Y., copyright 1978, p. 145.

*Primary Examiner*—Anton O. Oechsle

[57] ABSTRACT

A puzzle is provided and consists of a pair of open end horseshoes, a pair of chains connected between the open end horseshoes and a closed end horseshoe placed around the pair of chains. The closed end horseshoe may be removed from the pair of chains thus solving the puzzle. Each chain has sleeves connected to end links thereof. The sleeves are slidably engaged over the respective ends of the open end horseshoes so that the chains can be removed and replaced as needed.

1 Claim, 6 Drawing Figures

HORSESHOE PUZZLE

BACKGROUND OF THE INVENTION

The instant invention relates generally to puzzles and more specifically it relates to a puzzle formed from three horseshoes and chains.

Numerous puzzles have been provided in prior art that are adapted to be manipulated to be solved. For example U.S. Pat. Nos. 543,188; 584,857 and 779,874 all are illustrative of such prior art. While these units may be suitable for the particular purpose to which they address, they would not be suitable for the purposes of the present invention as heretofore described.

SUMMARY OF THE INVENTION

A principle object of the present invention is to provide a puzzle that is of a simple design made from horseshoes and chains.

Another object is to provide a puzzle that can be solved by proper manipulation thereof.

An additional object is to provide a puzzle that is fun and entertaining when trying to solve.

A further object is to provide a puzzle that is simple and easy to use.

A still further object is to provide a puzzle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
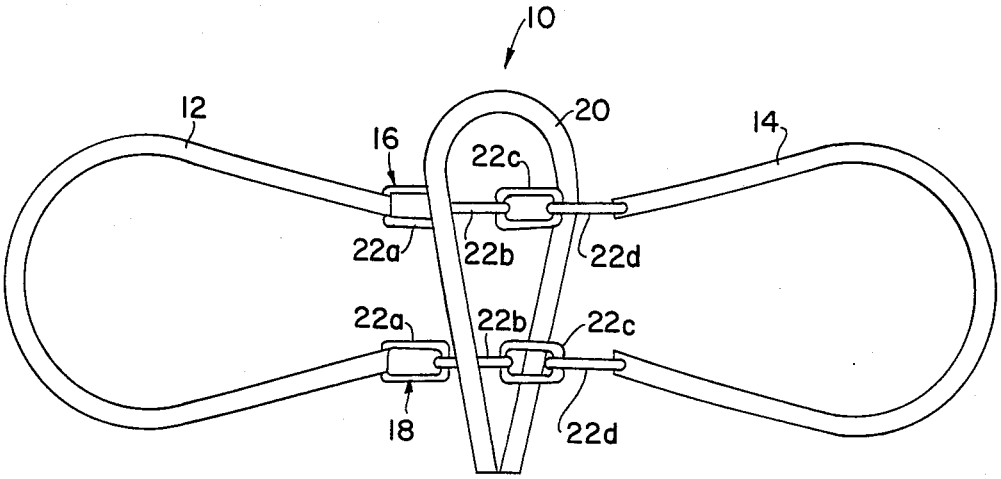
FIG. 1 is a plan view of the puzzle.

Turning now descriptively to the drawings, in which similar reference characters denote similar elements throughout the several views, FIG. 1 illustrates a puzzle 10 that consists of a pair of open end horseshoes 12 and 14, a pair of chains 16 and 18 connected between the open end horseshoes 12 and 14 and a closed end horseshoe 20 placed around the pair of chains 16 and 18. The closed end horseshoe 20 may be removed from the pair of chains 16 and 18 thus solving the puzzle. For best results each chain 16 and 18 consists of four links 22*a*, 22*b*, 22*c* and 22*d* thereon.

Figure 2:
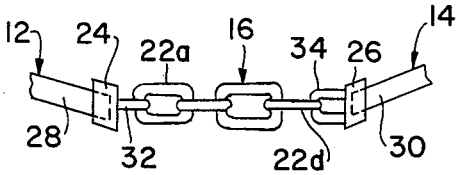
FIG. 2 is a detail view of a modification of the puzzle showing one of the chains mounted to a pair of sleeves for replacement purposes.
Figure 3:
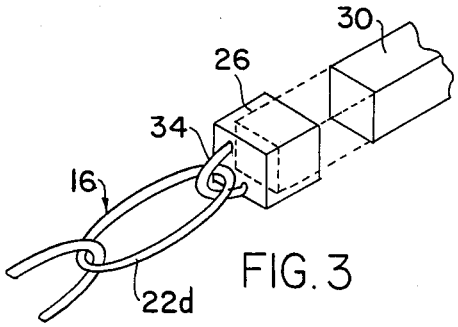
FIG. 3 is a partial perspective view of the modification shown in FIG. 2 thereof.

FIG. 2 illustrates a set of sleeves 24 and 26. Sleeve 24 is connected between an end link 22*a* of the chain 16 and an open end 28 of a horseshoe 12. Sleeve 26 is connected between an end link 22*d* of chain 16 and an open end 30 of a horseshoe 14. The chain 16 can be removed and replaced when needed. Another set of sleeves (not shown) are connected, in the same way as sleeves 24 and 26, between horseshoe 12 and 14 to the chain 18 (not shown). A loop 32 on sleeve 24 and a loop 34 on sleeve 26 is utilized to engage link 22*a* and 22*d* so that chain 16 can easily swivel. FIG. 3 shows the sleeve 26 with loop 34 in detail separated from the open end 30. Link 22*d* of chain 16 is attached to the loop 34.

Figure 4:
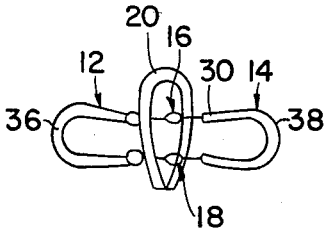
FIGS. 4, 5 and 6 are plan views showing the puzzle in different relative positions in the progressive order passed through in the operation of detaching the center horseshoe.
Figure 5:
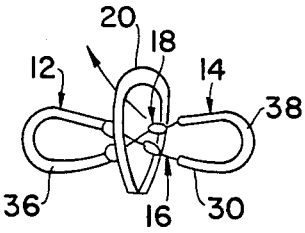
Figure 6:
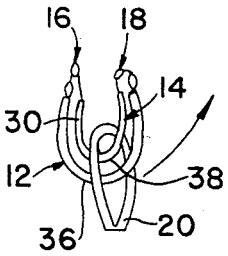

In solving the puzzle 10 the following steps must be taken as shown in FIGS. 4, 5 and 6.

Step 1. Hold each open end horseshoe 12 and 14 at curved ends 36 and 38.

Step 2. Twist the open end horseshoe 14 over crossing the chains 16 and 18.

Step 3. Push the end 30 of the open end horseshoe 14 through the closed end horseshoe 20. Shake and wiggle if needed.

Step 4. Lift up the closed end horseshoe 20 to remove completely.

Step 5. To replace closed end horseshoe 20 simply reverse procedure of steps.

The open end horseshoes 12 and 16, the closed end horseshoe 20, the chains 16 and 18 and the sleeves can all be made of metal, plastic or any other durable material that will hold up in use for solving the puzzle 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A puzzle which comprises:

(a) a pair of open end horseshoes:

(b) a pair of chains adapted to be connected between said open horseshoes; and (c) a closed end horseshoe placed around said pair of chains whereby said closed end horseshoe may be removed from said pair of chains thus solving said puzzle, wherein each said chain comprises four links thereon that further comprises two sets of sleeves, each sleeve connected to an end link of said chains and adapted to be removeably mounted on an end of said open end horsehoes so that said chains can be removed and replaced when needed.

* * * * *